US008673095B2

(12) United States Patent
Dagenais

(10) Patent No.: US 8,673,095 B2
(45) Date of Patent: Mar. 18, 2014

(54) SYSTEM AND METHOD FOR REPAIRING A SCREEN FOR USE IN THE PAPER MILL INDUSTRY

(76) Inventor: Daniel Dagenais, St-Hippolyte (CA)

( * ) Notice: Subject to any disclaimer, the term of this patent is extended or adjusted under 35 U.S.C. 154(b) by 0 days.

(21) Appl. No.: 13/525,334

(22) Filed: Jun. 17, 2012

(65) Prior Publication Data

US 2012/0318437 A1 Dec. 20, 2012

(30) Foreign Application Priority Data

Jun. 17, 2011 (GB) ..... 1110286.0

(51) Int. Cl.
*B32B 43/00* (2006.01)

(52) U.S. Cl.
USPC ..... 156/98; 156/510; 29/401; 29/402.08; 29/402.09; 29/402.11

(58) Field of Classification Search
USPC ..... 156/98, 510; 29/401, 402.08, 402.09, 29/402.11
See application file for complete search history.

(56) References Cited

U.S. PATENT DOCUMENTS

| | | | | |
|---|---|---|---|---|
| 2,397,646 A | | 4/1946 | Brown | |
| 2,487,830 A | | 11/1949 | Robbins, II | |
| 3,553,416 A | | 1/1971 | Schmiege et al. | |
| 3,664,907 A | | 5/1972 | Price | |
| 3,681,841 A | * | 8/1972 | LeBlanc et al. | 29/402.13 |
| 3,734,795 A | | 5/1973 | Griffith | |
| 4,728,530 A | * | 3/1988 | Waldvogel et al. | 427/501 |
| 4,926,533 A | | 5/1990 | Couture | |
| 5,275,293 A | | 1/1994 | Crider | |
| 6,027,079 A | | 2/2000 | Santoro | |

FOREIGN PATENT DOCUMENTS

| | | |
|---|---|---|
| CA | 962569 | 2/1975 |
| EP | 0234197 | 1/1987 |
| EP | 0378412 | 7/1990 |
| WO | WO0048747 | 8/2000 |

* cited by examiner

*Primary Examiner* — Jeff Aftergut
*Assistant Examiner* — Jaeyun Lee

(57) ABSTRACT

A system and method for repairing a screen for use in the paper mill industry consists in using a small circular-shaped die or rotary cutter to cut through a multilayer wire. A first, small diameter punch die is used to cut through all of the damaged layers and then, each successive punch die is configured with a larger diameter and a flange that makes it go less deeply so that it cuts all but the bottom most damaged layer. The process is repeated for each layer with increasing diameter punch dies so that each hole is larger in diameter. In doing so, it is easy to reach the bottom most layer from the top, put in a patch and micro weld it and then move up to the next layer and still having room for the welding because of a larger hole still on the layer above it.

5 Claims, 3 Drawing Sheets

FIG. 1a
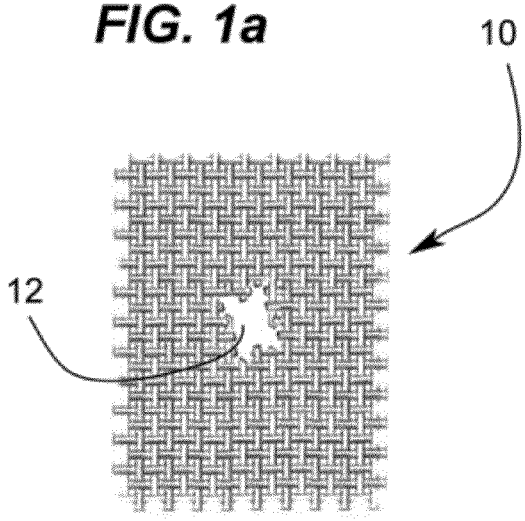
FIG. 1c
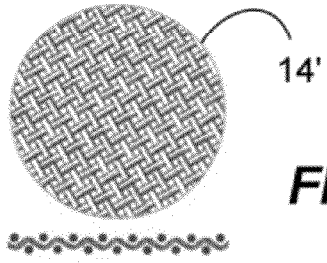
FIG. 1d
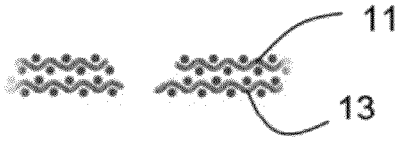
FIG. 1b
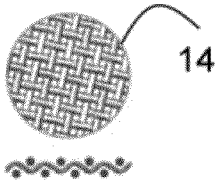
FIG. 1e
FIG. 1f
FIG. 1g
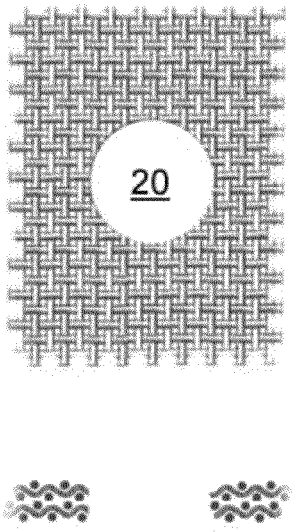
FIG. 1h
FIG. 1i
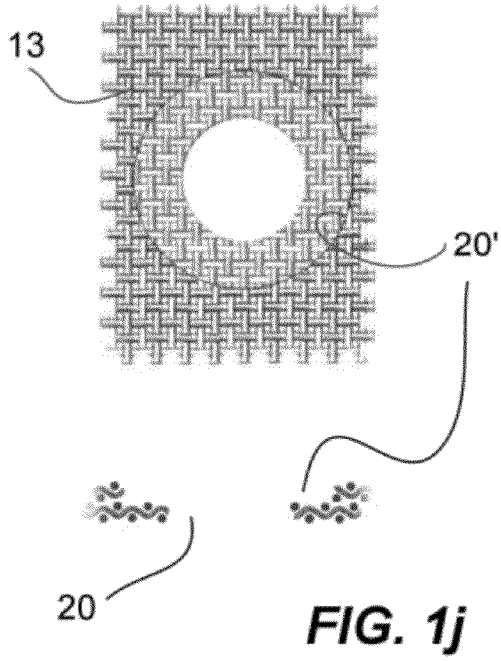
FIG. 1j

SYSTEM AND METHOD FOR REPAIRING A SCREEN FOR USE IN THE PAPER MILL INDUSTRY

FIELD OF THE INVENTION

The present invention relates generally to canvas, screen and fabric repair, but more particularly to a paper-making screen repair method and patch assembly process for patching perforations accidentally made in a paper-making pulp-dewatering screenfabric, also known as "wire" in the industry.

BACKGROUND OF THE INVENTION

In the process of making paper, water has to be extracted from the pulp, and so the pulp is laid over a large screen, called wire. Paper-making wires used for pulp-dewatering consist of multiple layers of a woven fabric made of synthetic resin fibers. Such wires can become accidentally perforated during use. A perforated fabric causes defects in the paper and the wire must be replaced or repaired. Such wires are very expensive, costing over one hundred thousand dollars. Replacing a damaged wire can take many hours, causing downtime of the paper-making machine. It has therefore been tried, but without success to repair perforations with patches. There are, however, many disadvantages to using patches. For example, repairs involving chemical adhesives, do not last as the patches fall off because of the speed at which the wires move (vibration, centrifugal force, etc). Sewing and stapling repair methods offer better resistance to mechanical wear, but do so at the expense of protrusions which introduce undesirable turbulences on the pulp-contacting wire surface, which results in defects in the paper being made.

Resistance to mechanical and chemical wear as well as evenness of the patch surface is therefore highly desirable. Ability to repair the wire without removing the wire from the paper-making machine is also highly desirable in order to minimize downtime and associated financial losses.

SUMMARY OF THE INVENTION

In view of the foregoing disadvantages inherent in the known devices now present in the prior art, the present invention, which will be described subsequently in greater detail, is to provide objects and advantages which are:

To provide for a system to repair a perforation on a paper-making wire in such a way that the patch used for repairing the perforation remains attached to the wire and that it will not introduce protrusions on the pulp-contacting face of the wire.

Another object of the present invention is to provide a method and the means to fix the perforation to a multilayer wire, so that all layers can be repaired even when only the pulp-contacting face of the wire is accessible.

Yet another advantage of the invention is to provide for a way to repair small perforations within minutes by a skilled technician and without having to remove the wire from the paper-making machine so as to minimize the downtime on the paper-making machine.

In order to do so, the repair system and method consist in using a small circular-shaped die or rotary cutter to cut through a multilayer wire. A first, small diameter punch die is used to cut through all of the damaged layers and then, each successive punch die is configured with a larger diameter and a flange that makes it go less deeply so that it cuts all but the bottom most damaged layer. The process is repeated for each layer with increasing diameter punch dies so that each hole is larger in diameter. In doing so, it is easy to reach the bottom most layer from the top, put in a patch and micro weld it and then move up to the next layer and still having room for the welding because of a larger hole still on the layer above it. There are at least two layers (such as in the drawing figures) but typical installations can have three or more layers. The circular shape of the patches, and the micro welds of each individual layer not being aligned, virtually eliminates protrusion defects while ensuring superior resistance to mechanical wear. The micro welding technique ensures optimal molecular compatibility with exact welding temperature between the patch and the fabric for greater resistance to chemical wear.

The system and method of repairing wherein the screen layers and patches are formed from synthetic resin fiber.

The system and method wherein the first die and each said successive dies are formed having a flange designed and shaped to cut through only a chosen number of successive damaged screen layers.

The system and method wherein each synthetic resin fiber is micro-welded individually.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter which contains illustrated preferred embodiments of the invention.

BRIEF DESCRIPTION OF THE DRAWINGS

FIGS. 1*a-j* Plan and side cutaways views illustrating the steps involved dye cutting holes along with examples of patches.

DETAILED DESCRIPTION OF THE PREFERRED EMBODIMENT

Figure 2A:
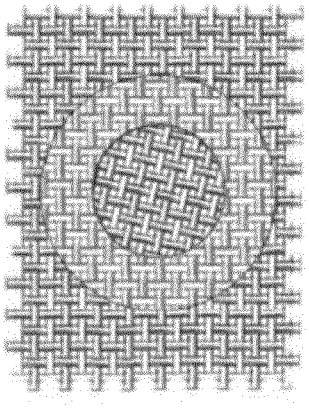
FIGS. 2*a-h* Plan and side cutaways views illustrating the steps involved in putting and fusing patches.
Figure 2C:
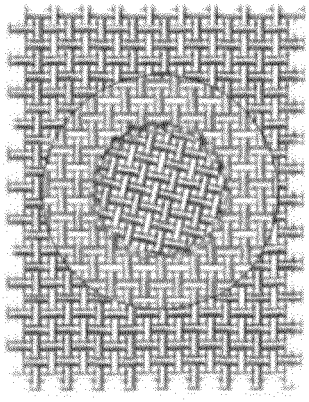
Figure 2B:
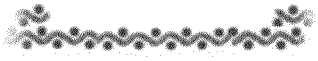
Figure 2D:
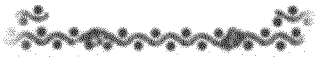
Figure 2E:
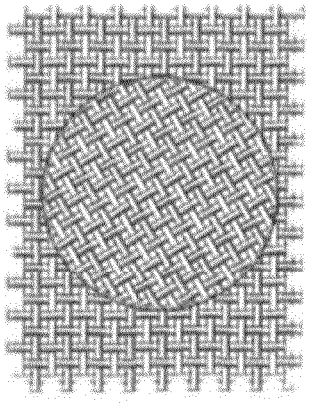
Figure 2F:
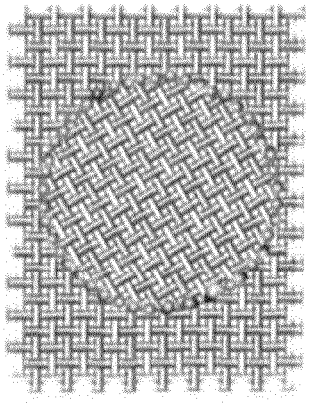
Figure 2G:
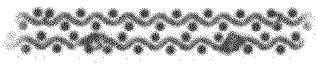
Figure 2H:
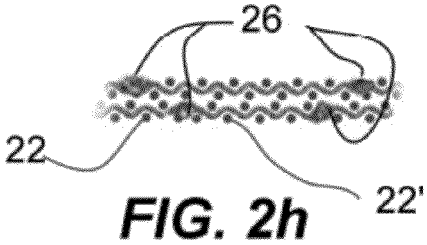
Figure 3A:
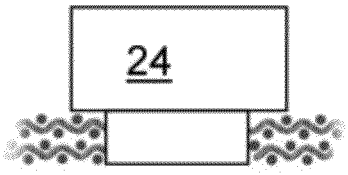
FIGS. 3*a-b* Side views showing how different punch die cut through different layers.
Figure 3B:
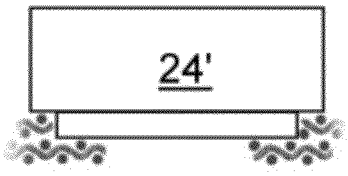
Figure 4:
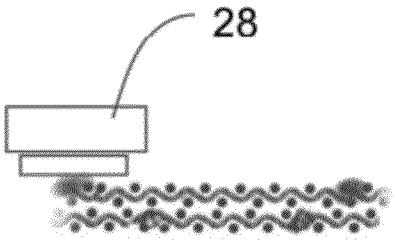
FIG. 4 Side view showing the buffer member abrading a fusion lump.

A system and method of repairing a paper-making multi-layer screen (10) having a perforation (12) is comprised of the steps of:

a) using a punch die (24) to cut through all layers (11, 13) or at least all the damaged ones from the top down by cutting around where a perforation (12) is located so that the perforation now becomes a regularly shaped round hole (20).

b) a slightly larger circular-shaped punch die (24') is used to cut through all but the bottom most layer (13).

c) at the bottom most layer (11) a first patch (14) is placed inside the hole (20).

d) heat is applied to fibers (22, 22') so that they can fuse together. Any fusion lump (24) is abraded down through buffing using a buffer member (28).

e) the process is repeated for the top layer (11) using a larger punch die (24') to make a larger hole (20') filled with a larger patch (14') so that the fusion lumps (26) are not directly aligned, which ensures a smoother surface and a better resistance to mechanical and chemical wear. Fibers (22, 22') are individually micro welded using resin fiber and optimal heat according to the specific nature of the resin.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, punch dies are the preferred tool used but other types of cutters such as rotary drill cutters could be used and still achieve a similar result.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A method of repairing a paper-making, pulp-dewatering, multi-layer screen having an unwanted perforation, said method comprising the steps of:

a.) cutting through all of the damaged screen layers from a top surface of the top damaged layer through a bottom surface of the bottom damaged layer, and removing the screen material that was cut;

b.) cutting through all the screen layers to make a larger cut but not cutting the bottom most damaged screen layer, and removing the screen material that was cut by the successive punch die;

c.) repeating step b. until all the damaged screen layers have been cut, thereby forming successive holes in successive layers that increase in diameter incrementally from said bottom damaged layer to said top damaged layer;

d.) putting a first patch into said bottom damaged layer hole and micro-welding it to said bottom damaged layer and abrading any fusion lumps that may occur during said micro-welding to thereby ensure a smooth transition surface between said bottom damaged layer and said first patch;

e.) micro-welding a successive patch into a hole of a successive damaged layer above the damaged layer previously patched; and abrading any fusion lumps that may occur during said micro-welding to thereby ensure a smooth transition surface between the successive damaged layer and said respective successive patch;

f.) repeating step e. until all the damaged screen layers have been patched.

2. The method of repairing a paper-making, pulp-dewatering, multi-layer of claim 1, wherein said screen layers and patches are formed from synthetic resin fiber.

3. The method of repairing a paper-making, pulp-dewatering, multi-layer of claim 1, wherein said first die and each said successive dies are formed having a flange designed and shaped to cut through only a chosen number of successive damaged screen layers.

4. The method of repairing a paper-making, pulp-dewatering, multi-layer of claim 2, wherein each said synthetic resin fiber is micro-welded individually.

5. The method of repairing a paper-making, pulp-dewatering, multi-layer of claim 1 wherein rotary drill cutters are used for cutting holes in the layers or punch dies are used for cutting holes in the layers.

* * * * *